US011355064B2

(12) United States Patent
Jeon et al.

(10) Patent No.: US 11,355,064 B2
(45) Date of Patent: Jun. 7, 2022

(54) PIXEL CIRCUIT AND DISPLAY DEVICE INCLUDING THE SAME

(71) Applicant: SAMSUNG DISPLAY CO., LTD., Yongin-si (KR)

(72) Inventors: Joo-Hee Jeon, Gyeonggi-do (KR); Gun-Hee Kim, Seoul (KR); Ju-Won Yoon, Suwon-si (KR); Seung-Chan Lee, Hwaseong-si (KR); Sang-Ho Park, Hwaseong-si (KR); Joo-Sun Yoon, Seoul (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 17/265,332

(22) PCT Filed: Jun. 28, 2019

(86) PCT No.: PCT/KR2019/007897
§ 371 (c)(1),
(2) Date: Feb. 2, 2021

(87) PCT Pub. No.: WO2020/027445
PCT Pub. Date: Feb. 6, 2020

(65) Prior Publication Data

US 2021/0319747 A1 Oct. 14, 2021

(30) Foreign Application Priority Data

Aug. 2, 2018 (KR) ..... 10-2018-0090287

(51) Int. Cl.
*G09G 3/3233* (2016.01)

(52) U.S. Cl.
CPC ... *G09G 3/3233* (2013.01); *G09G 2300/0417* (2013.01); *G09G 2300/0819* (2013.01);
(Continued)

(58) Field of Classification Search
CPC .. G09G 3/3233; G09G 3/3258; G09G 3/3291; G09G 2300/0417;
(Continued)

(56) References Cited

U.S. PATENT DOCUMENTS

2011/0157125 A1* 6/2011 Choi ..... G09G 3/3291 315/160
2016/0064411 A1* 3/2016 Park ..... G09G 3/3233 257/89

(Continued)

FOREIGN PATENT DOCUMENTS

CN 107706208 A 2/2018
KR 1020160098650 A 8/2016

(Continued)

OTHER PUBLICATIONS

International Search Report for PCT/KR2019/007897 dated Sep. 30, 2019.

(Continued)

*Primary Examiner* — Michael J Eurice
(74) *Attorney, Agent, or Firm* — Cantor Colburn LLP

(57) ABSTRACT

A pixel circuit includes an OLED, a first transistor including a gate electrode connected to a first node and an electrode connected to a third node, a capacitor including a first electrode for receiving a power supply voltage and a second electrode connected to the first node, a third transistor including a gate electrode for receiving a first gate signal, a first electrode connected to the first node, and a second electrode connected to the third node, a fourth transistor including a gate electrode for receiving a second gate signal, a first electrode connected to the first node, and a second electrode and a second gate electrode for receiving a first initialization voltage, and a seventh transistor including a gate electrode for receiving a third gate signal, a first electrode for receiving a second initialization voltage, and a
(Continued)

second electrode connected to an anode electrode of the OLED.

20 Claims, 6 Drawing Sheets

(52) U.S. Cl.
CPC ..... *G09G 2300/0842* (2013.01); *G09G 2300/0861* (2013.01); *G09G 2310/08* (2013.01); *G09G 2320/0214* (2013.01); *G09G 2320/0233* (2013.01); *G09G 2320/0257* (2013.01)

(58) Field of Classification Search
CPC ... G09G 2300/0819; G09G 2300/0842; G09G 2300/0852; G09G 2300/0861; G09G 2310/0262; G09G 2310/061; G09G 2310/08; G09G 2320/0214; G09G 2320/0233; G09G 2320/0257; G09G 2320/045; H01L 27/32
See application file for complete search history.

(56) References Cited

U.S. PATENT DOCUMENTS

2016/0233281 A1* 8/2016 Yoon ..... H01L 27/124
2017/0103701 A1* 4/2017 Zhu ..... G09G 3/3233
2017/0116922 A1* 4/2017 Jung ..... G09G 3/3258
2017/0124954 A1* 5/2017 Park ..... G09G 3/3258
2018/0040682 A1 2/2018 Ebisuno et al.
2018/0069069 A1 3/2018 Ebisuno et al.
2018/0130409 A1* 5/2018 Xiang ..... G09G 3/3225
2019/0096337 A1* 3/2019 Zhu ..... G09G 3/3258
2019/0259822 A1 8/2019 Jeon et al.
2020/0043949 A1* 2/2020 Lee ..... H01L 27/1255
2020/0410932 A1* 12/2020 Kobayashi ..... G09G 3/3291
2021/0202646 A1 7/2021 Ebisuno et al.

FOREIGN PATENT DOCUMENTS

KR 1020160141366 A 12/2016
KR 1020170049682 A 5/2017
KR 1020180026602 A 3/2018

OTHER PUBLICATIONS

Written Opinion for PCT/KR2019/007897 dated Sep. 30, 2019.
Chinese Office Action for Application No. 201980051590.1 dated Dec. 22, 2021 enumerating the above listed references in the Chinese Office Action.

* cited by examiner

PIXEL CIRCUIT AND DISPLAY DEVICE INCLUDING THE SAME

TECHNICAL FIELD

Embodiments according to the present invention relates to a pixel circuit and a display device including the same, and more particularly, to a pixel circuit for improving display quality and a display device including the pixel circuit.

BACKGROUND

An organic light emitting diode display device has been widely used as a display device for an electronic device.

The organic light emitting diode display device includes a plurality of pixels, and each of the pixels includes an organic light emitting diode and a pixel circuit configured to drive the organic light emitting diode. The pixel circuit includes a plurality of transistors and a plurality of capacitors.

The organic light emitting diode display device has problems such as leakage currents, afterimages, and deterioration of reliability upon the driving when the organic light emitting diode display device is driven at high luminance and high temperatures. For example, upon the driving at high temperatures, a threshold voltage of the transistor included in the pixel circuit may be shifted to increase a leakage current, resulting in a decrease in luminance. Such a decrease in luminance may degrade display quality.

CONTENT OF THE INVENTION

Problem to be Solved

One aspect of the present invention is to provide a pixel circuit for reducing a leakage current of a transistor.

Another aspect of the present invention is to provide a display device including the pixel circuit.

Means for Solving the Problem

According to embodiments, a pixel circuit includes: an organic light emitting diode which generates light for displaying an image; a first transistor including a first gate electrode connected to a first node, a first electrode connected to a second node, and a second electrode connected to a third node; a first capacitor including a first electrode which receives a power supply voltage and a second electrode connected to the first node; a second transistor including a first gate electrode which receives a first gate signal, a first electrode which receives a data voltage, and a second electrode connected to the second node; a third transistor including a first gate electrode which receives the first gate signal, a first electrode connected to the first node, and a second electrode connected to the third node; a fourth transistor including a first gate electrode which receives a second gate signal, a first electrode connected to the first node, a second electrode which receives a first initialization voltage, and a second gate electrode which receives the first initialization voltage; and a seventh transistor including a first gate electrode which receives a third gate signal, a first electrode which receives a second initialization voltage, and a second electrode connected to an anode electrode of the organic light emitting diode.

In embodiments, the first initialization voltage may be set as a negative voltage with respect to a reference voltage, and may be greater than the second initialization voltage.

In embodiments, the third transistor may further include a second gate electrode which receives the first initialization voltage.

In embodiments, the fourth transistor may include a fourth-first transistor and a fourth-second transistor and have a dual connection structure in which the fourth-first transistor and the fourth-second transistor are connected to each other through a fifth node.

In embodiments, the third transistor may include a third-first transistor and a third-second transistor and have a dual connection structure in which the third-first transistor and the third-second transistor are connected to each other through a fourth node.

In embodiments, the pixel circuit may further include a second capacitor including a first electrode which receives the power supply voltage and a second electrode connected to the fourth and fifth nodes.

In embodiments, the third transistor may further include a second gate electrode which receives the first gate signal.

In embodiments, the pixel circuit may further include: a fifth transistor including a first gate electrode which receives an emission control signal, a first electrode which receives the power supply voltage, and a second electrode connected to the second node; and a sixth transistor including a first gate electrode which receives the emission control signal, a first electrode connected to the third node, and a second electrode connected to the anode electrode of the organic light emitting diode.

In embodiments, each of the first, second, fifth, sixth, and seventh transistors may further include a second gate electrode overlapping the first gate electrode and which receives the same signal as a signal applied to the first gate electrode.

In embodiments, the second gate signal may be a previous signal applied before the first gate signal, and the third gate signal may be a next signal applied after the first gate signal.

According to embodiments, a display device includes a display panel and a scan driver. The display panel includes a pixel circuit that includes: an organic light emitting diode which generates light for displaying an image; a first transistor including a first gate electrode connected to a first node, a first electrode connected to a second node, and a second electrode connected to a third node; a first capacitor including a first electrode which receives a power supply voltage and a second electrode connected to the first node; a second transistor including a first gate electrode which receives a first scan signal, a first electrode which receive a data voltage, and a second electrode connected to the second node; a third transistor including a first gate electrode which receives the first scan signal, a first electrode connected to the first node, and a second electrode connected to the third node; a fourth transistor including a first gate electrode which receives a second scan signal, a first electrode connected to the first node, a second electrode which receives a first initialization voltage, and a second gate electrode which receives the first initialization voltage; and a seventh transistor including a first gate electrode which receives a third scan signal, a first electrode which receives a second initialization voltage, and a second electrode connected to an anode electrode of the organic light emitting diode. The scan driver generates a plurality of scan signals to provide the scan signals to the display panel.

In embodiments, the first initialization voltage may be set as a negative voltage with respect to a reference voltage, and may be greater than the second initialization voltage.

In embodiments, the third transistor may further include a second gate electrode which receives the first initialization voltage.

In embodiments, the fourth transistor may include a fourth-first transistor and a fourth-second transistor and have a dual connection structure in which the fourth-first transistor and the fourth-second transistor are connected to each other through a fifth node.

In embodiments, the third transistor may include a third-first transistor and a third-second transistor and have a dual connection structure in which the third-first transistor and the third-second transistor are connected to each other through a fourth node.

In embodiments, the pixel circuit may further include a second capacitor including a first electrode which receives the power supply voltage and a second electrode connected to the fourth and fifth nodes.

In embodiments, the third transistor may further include a second gate electrode which receives the first gate signal.

In embodiments, the pixel circuit may further include a fifth transistor including a first gate electrode which receives an emission control signal, a first electrode which receives the power supply voltage, and a second electrode connected to the second node, and a sixth transistor including a first gate electrode which receives the emission control signal, a first electrode connected to the third node, and a second electrode connected to the anode electrode of the organic light emitting diode.

In embodiments, each of the first, second, fifth, sixth, and seventh transistors may further include a second gate electrode overlapping the first gate electrode and which receives the same signal as a signal applied to the first gate electrode.

In embodiments, the first scan signal may be an nth scan signal, the second scan signal may be an (n−1)th scan signal, and the third scan signal may be an (n+1)th scan signal, and n is a natural number more than 1.

Effects of the Invention

According to a pixel circuit and a display device including the same according to embodiments of the present invention, transistors of a pixel circuit have a double gate structure including a first gate electrode and a second gate electrode, and a negative bias voltage is applied to a second gate electrode of at least one transistor which control a capacitor among the transistors, so that a leakage current can be reduced upon the driving at high temperatures. Accordingly, display quality can be prevented from deteriorating due to the leakage current.

DETAILED DESCRIPTION

Hereinafter, embodiments of the present inventive concept will be explained in detail with reference to the accompanying drawings.

Figure 1:
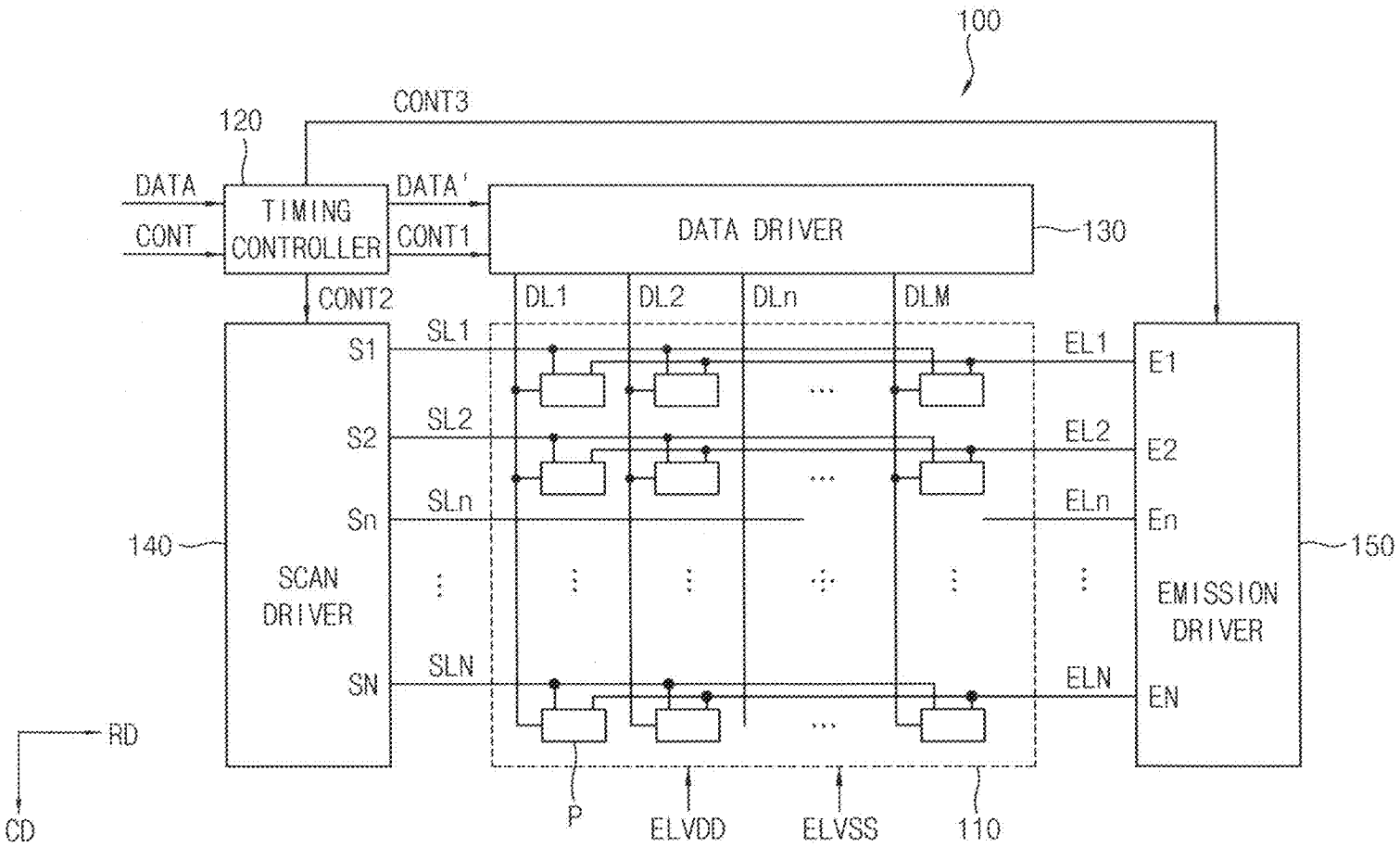
FIG. 1 is a block diagram illustrating a display device according to embodiments.

FIG. 1 is a block diagram illustrating a display device according to embodiments.

Referring to FIG. 1, a display device 100 may include a display panel 110, a timing controller 120, a data driver 130, a scan driver 140, and an emission driver 150.

The display panel 110 may include a plurality of pixels P, a plurality of scan lines SL1, . . . , SLn, . . . , and SLN, a plurality of data lines DL1, . . . , DLm, . . . , and DLM, and a plurality of emission control lines EL1, . . . , ELn, . . . , and ELN (where n, N, m, and M are natural numbers).

The pixels may be arranged in the form of a matrix including a plurality of pixel rows and a plurality of pixel columns. With respect to the display panel 110, the pixel row may correspond to a group of pixels disposed in the same horizontal line, and the pixel column may correspond to a group of pixels disposed in the same vertical line.

Each of the pixels P may include a pixel circuit PC, and the pixel circuit PC may include a plurality of transistors connected to the scan lines, the data lines, and the emission control lines, and an organic light emitting diode driven by the transistors.

According to an embodiment, the transistors of the pixel circuit PC may have a double gate structure in order to improve afterimages and enhance reliability of the transistor. The transistor having the double gate structure may include a first gate electrode and a second gate electrode. The second gate electrode may be configured as a bottom metal layer with respect to the first gate electrode.

The transistors having the double gate structure may be configured such that the same gate signal is applied to the first and second gate electrodes, or at least one transistor may be configured such that a bias signal different from a gate signal applied to the first gate electrode is applied to the second gate electrode.

The data lines DL1, . . . , DLm, . . . , and DLM may extend in a column direction CD, and may be arranged in a row direction RD. The data lines DL1, . . . , DLm, . . . , and DLM may be connected to the data driver 130 to transmit data voltages to the pixels P.

The scan lines SL1, . . . , SLn, . . . , and SLN may extend in the row direction RD, and may be arranged in the column direction CD. The scan lines SL1, . . . , SLn, . . . , and SLN may be connected to the scan driver 140 to transmit scan signals to the pixels P.

The emission control lines EL1, . . . , ELn, . . . , and ELN may extend in the row direction RD, and may be arranged in the column direction CD. The emission control lines EL1, . . . , ELn, . . . , and ELN may be connected to the emission driver 150 to transmit emission control signals to the pixels P.

In addition, the pixels P may receive a first power supply voltage ELVDD and a second power supply voltage ELVSS.

Each of the pixels P may receive the data voltage in response to the scan signal, and may generate light having a gray scale corresponding to the data voltage by using the first and second power supply voltages ELVDD and ELVSS.

The timing controller 120 may receive an image signal DATA and a control signal CONT from an external device. The image signal DATA may include red, green, and blue image data. The control signal CONT may include a horizontal synchronization signal, a horizontal synchronization signal, a main clock signal, and the like.

The timing controller 120 may output image data DATA' converted from the image signal DATA according to specifications such as a pixel structure and resolution of the display panel 110.

The timing controller 120 may generate a first control signal CONT1 for driving the data driver 130, a second control signal CONT2 for driving the scan driver 140, and a third control signal CONT3 for driving the emission driver 150 based on the control signal CONT.

The data driver 130 may convert the image signal DATA' into the data voltage in response to the first control signal CONT1, and may output the data voltage to the data lines DL1, . . . , DLm, . . . , and DLM.

The scan driver 140 may generate a plurality of scan signals Si, . . . , Sn, . . . , and SN in response to the second control signal CONT2.

The emission driver 150 may generate a plurality of emission control signals in response to the third control signal CONT3. The emission driver 150 may simultaneously output a plurality of emission control signals μl, . . . , En, . . . , and EN to the emission control lines EL1, . . . , ELn, . . . , and ELN, respectively, or may sequentially output the emission control signals μl, . . . , En, . . . , and EN to the emission control lines EL1, . . . , ELn, . . . , and ELN in an order from EL1 to ELN, according to the third control signal CONT3.

Figure 2:
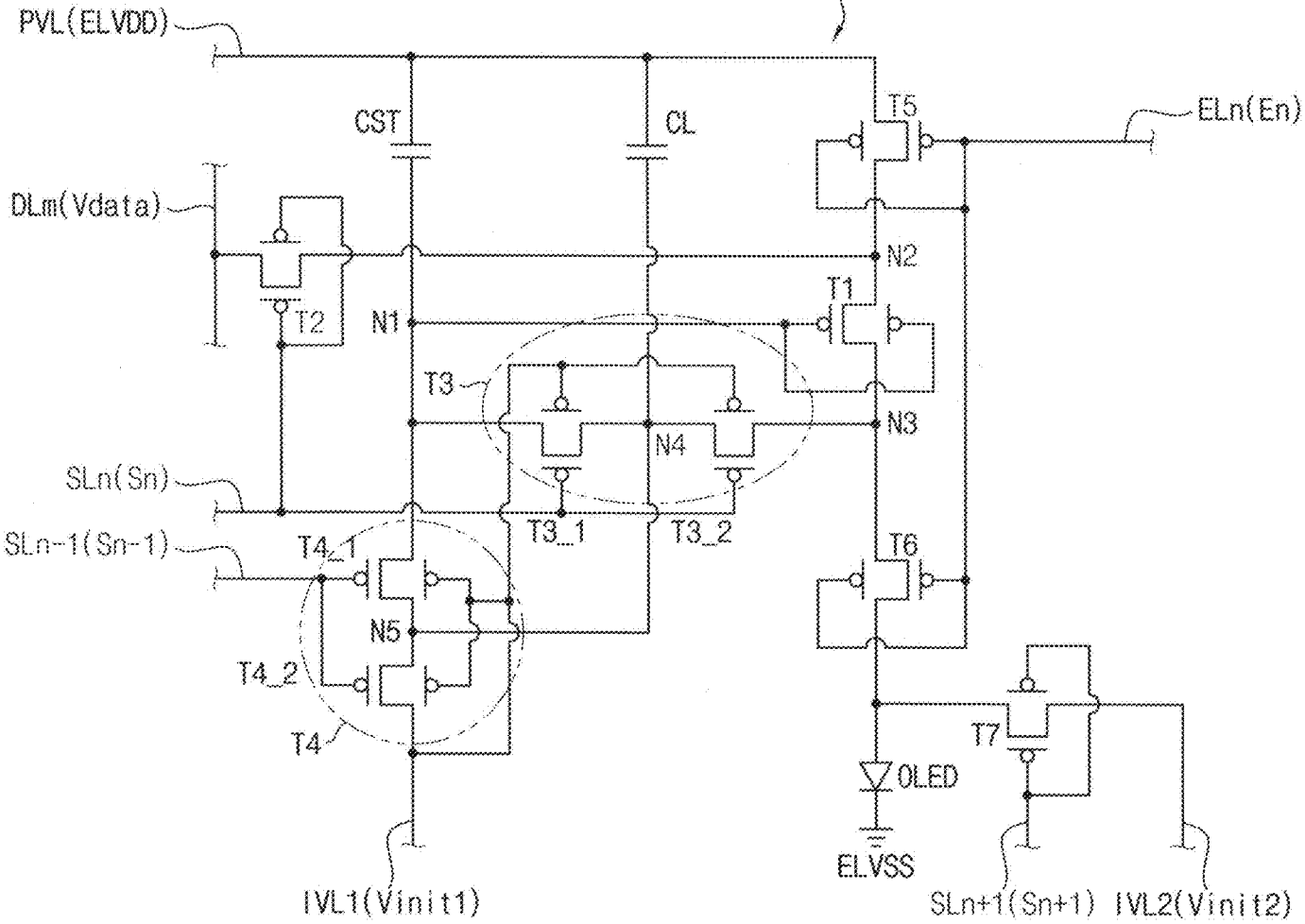
FIG. 2 is a circuit diagram illustrating a pixel circuit according to embodiments.

FIG. 2 is a circuit diagram illustrating a pixel circuit according to embodiments.

Referring to FIGS. 1 and 2, the pixel P may include a pixel circuit PC.

The pixel circuit PC may include an organic light emitting diode OLED, a first transistor T1, a first capacitor CST, a second transistor T2, a third transistor T3, a fourth transistor T4, a second capacitor CL, a fifth transistor T5, a sixth transistor T6, and a seventh transistor T7.

According to an embodiment, in order to improve the afterimages and enhance the reliability of the transistor, the transistor may have a double gate structure including a first gate electrode and a second gate electrode overlapping the first gate electrode under the first gate electrode.

According to an embodiment, the transistor may be a P-type transistor, which may be turned on when a low-level voltage is applied to the gate electrode, and may be turned off when a high-level voltage is applied to the gate electrode. In another embodiment, the transistors may be implemented as N-type transistors. In this case, a turn-on voltage may be the high-level voltage, and a turn-off voltage may be the low-level voltage.

The pixel circuit PC may further include a $m^{th}$ data line DLm, an $n^{th}$ scan line SLn, an $(n-1)^{th}$ scan line SLn−1, an $(n+1)^{th}$ scan line SLn+1, an $n^{th}$ emission control line ELn, a power supply voltage line PVL, a first initialization voltage line IVI1, and a second initialization voltage line IVL2.

For example, the first transistor T1 may include a first gate electrode and a second gate electrode which are connected to a first node N1, a first electrode connected to a second node N2, and a second electrode connected to a third node N3.

The first capacitor CST may include a first electrode connected to the power supply voltage line PVL and a second electrode connected to the first node N1. The power supply voltage line PVL may provide a high-power supply voltage ELVDD.

The second transistor T2 may include a first gate electrode and a second gate electrode configured to receive a first gate signal, a first electrode connected to the $m^{th}$ data line DLm, and a second electrode connected to the second node N2. The $m^{th}$ data line DLm may transmit a data voltage Vdata corresponding to the pixel P. The first gate signal may be an $n^{th}$ scan signal Sn provided from the scan driver 140, and may be transmitted through the $n^{th}$ scan line SLn.

The third transistor T3 may include a third-first transistor T3-1 and a third-second transistor T3-2 and have a dual connection structure in which the third-first transistor T3-1 and the third-second transistor T3-2 are connected to each other through a fourth node N4.

According to an embodiment, the third transistor T3 may have the dual connection structure in order to reduce a leakage current occurred upon the driving at high luminance and high temperatures.

The third-first transistor T3-1 may include a first gate electrode configured to receive the first gate signal (i.e., $n^{th}$ scan signal Sn), a first electrode connected to the first node N1, a second electrode connected to the fourth node N4, and a second gate electrode connected to the first initialization voltage line IVL1. The first initialization voltage line IVL1 may transmit a first initialization voltage Vinit1 for initializing a charging voltage of the first capacitor CST. The first initialization voltage Vinit1 may be a negative voltage with respect to a reference voltage. That is, the first initialization voltage Vinit1 may have a value less than a value of the reference voltage.

The third-second transistor T3-2 may include a first gate electrode configured to receive the first gate signal, a first electrode connected to the fourth node N4, a second electrode connected to the third node N3, and a second gate electrode connected to the first initialization voltage line IVL1.

The first gate signal may be the $n^{th}$ scan signal provided from the scan driver 140, and may be transmitted through the $n^{th}$ scan line SLn.

The fourth transistor T4 may include a fourth-first transistor T4-1 and a fourth-second transistor T4-2 and have a dual connection structure in which the fourth-first transistor T4-1 and the fourth-second transistor T4-2 are connected to each other through a fifth node N5.

According to an embodiment, the fourth transistor T4 may have the dual connection structure in order to reduce the leakage current occurred upon the driving at high luminance and high temperatures.

The fourth-first transistor T4-1 may include a first gate electrode configured to receive a second gate signal, a first electrode connected to the first node N1, a second electrode connected to the fifth node N5, and a second gate electrode connected to the first initialization voltage line IVL1.

The fourth-second transistor T4-2 may include a first gate electrode configured to receive the second gate signal, a first electrode connected to the fifth node N5, and a second electrode and a second gate electrode which are connected to the first initialization voltage line IVL1.

The second gate signal may be an $(n-1)^{th}$ scan signal Sn−1 provided from the scan driver 140, and may be transmitted through the $(n-1)^{th}$ scan line SLn−1.

The second capacitor CL may include a first electrode, and a second electrode. The first electrode connected to the power supply voltage line PVL. The second electrode is connected to the third transistor T3 and the fourth transistor T4 through the fourth node N4 and the fifth node N5, respectively. The second capacitor CL may control leakage currents of the third transistor T3 and the fourth transistor T4.

The fifth transistor T5 may include a first gate electrode and a second gate electrode connected to the $n^{th}$ emission control line ELn, a first electrode connected to the power supply voltage line PVL, and a second electrode connected to the second node N2. The $n^{th}$ emission control line ELn may receive an $n^{th}$ emission control signal En provided from the emission driver 150.

The sixth transistor T6 may include a first gate electrode and a second gate electrode connected to the $n^{th}$ emission control line ELn, a first electrode connected to the third node N3, and a second electrode connected to an anode electrode of the organic light emitting diode OLED.

The seventh transistor T7 may include a first gate electrode and a second gate electrode configured to receive a third gate signal, a first electrode connected to the second initialization voltage line IVL2, and a second electrode connected to the anode electrode of the organic light emitting diode OLED. The second initialization voltage line IVL2 may transmit a second initialization voltage Vinit2 to the seventh transistor T7 for initializing the anode electrode. The second initialization voltage Vinit2 may be a negative voltage with respect to the reference voltage. That is, the second initialization voltage Vinit2 may have a value less than a value of the reference voltage.

According to an embodiment, the first initialization voltage Vinit1 may be set as a negative voltage greater than the second initialization voltage Vinit2.

The third gate signal may be an $(n+1)^{th}$ scan signal Sn+1 provided from the scan driver 140, and may be transmitted through the $(n+1)^{th}$ scan line SLn+1.

Figure 3:
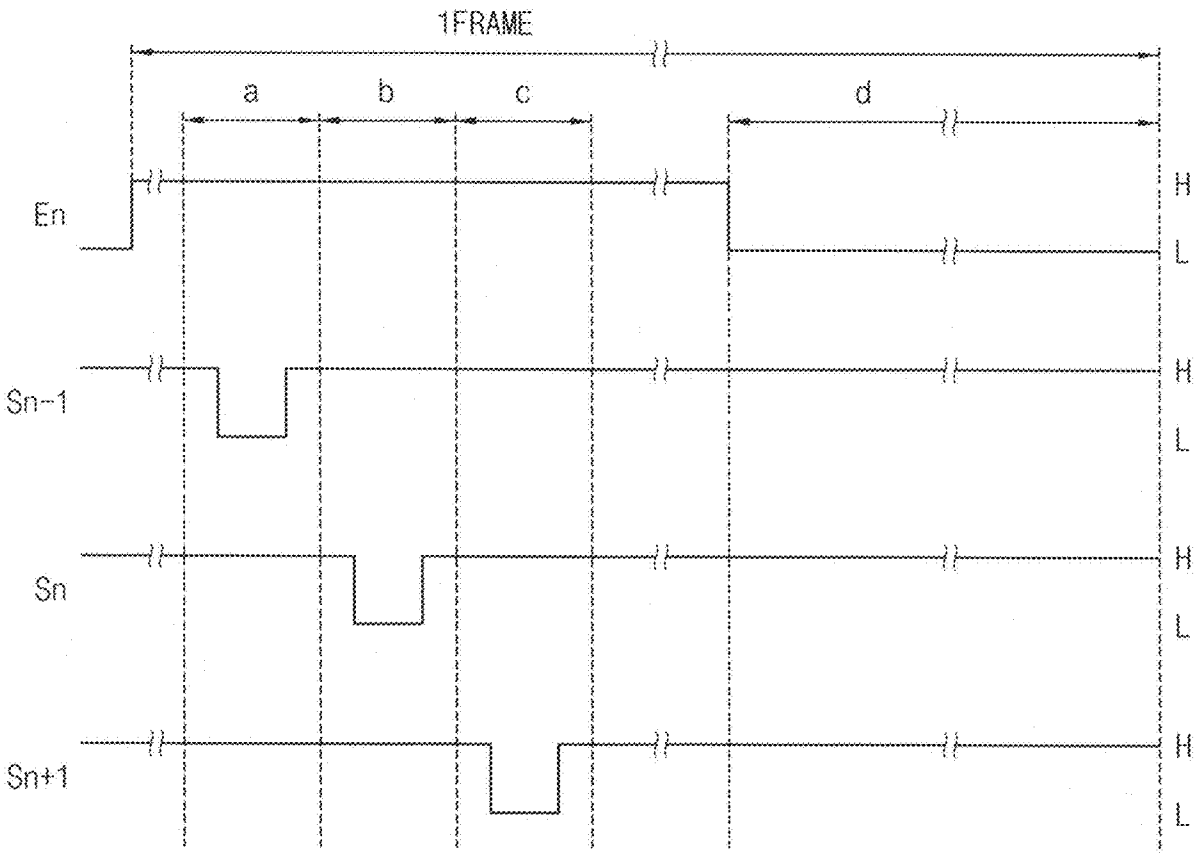
FIG. 3 is a waveform diagram illustrating a method of driving the pixel circuit of FIG. 2.

FIG. 3 is a waveform diagram illustrating a method of driving the pixel circuit of FIG. 2.

Referring to FIGS. 2 and 3, a method of driving the pixel circuit PC will be described as follows.

During a first interval a of a frame, in response to a low voltage of the $(n-1)^{th}$ scan signal Sn−1 applied to the $(n-1)^{th}$ scan line SLn−1, the fourth-first transistor T4-1 and the fourth-second transistor T4-2 having the dual connection structure may be turned on, and the remaining transistors T1, T2, T3, T5, T6, and T7 may be turned off. Accordingly, the first capacitor CST may be charged to the first initialization voltage Vinit1 applied by the first initialization voltage line IVl1. The first initialization voltage Vinit1 may be a negative bias voltage, and may be greater than the second initialization voltage Vinit2.

During a second interval b of the frame, in response to a low voltage of the $n^{th}$ scan signal Sn applied to the $n^{th}$ scan line SLn, the second transistor T2, and the third-first transistor T3-1 and the third-second transistor T3-2 having the dual connection structure may be turned on, and the remaining transistors T1, T4, T5, T6, and T7 may be turned off.

As the third-first transistor T3-1 and the third-second transistor T3-2 are turned on, the first transistor T1 may be diode-connected. A difference value in voltage between a voltage applied to the second node N2 and corresponding to the data voltage Vdata applied to the $m^{th}$ data line DLm and a threshold voltage Vth of the first transistor T1 may be applied to the first node N1. Accordingly, a difference value in voltage between absolute values of the voltage corresponding to the data voltage Vdata and the threshold voltage Vth may be applied to the first node N1 to compensate for the threshold voltage of the first transistor T1.

In addition, the first capacitor CST may be charged with the voltage corresponding to the data voltage Vdata applied to the $m^{th}$ data line DLm.

As described above, during the second interval b of the frame, the threshold voltage Vth of the first transistor T1 may be compensated, and the voltage corresponding to the data voltage Vdata may be stored in the first capacitor CST.

During a third interval c of the frame, in response to a low voltage of the $(n+1)^{th}$ scan signal Sn+1 applied to the $(n+1)^{th}$ scan line SLn+1, the seventh transistor T7 may be turned on, and the remaining transistors T1, T2, T3, T4, T5, and T6 may be turned off.

As the seventh transistor T7 is turned on, the second initialization voltage Vinit2 applied to the second initialization voltage line IVL2 may be applied to the anode electrode of the organic light emitting diode OLED to initialize the anode electrode of the organic light emitting diode OLED.

As described above, during the third interval c of the frame, the anode electrode of the organic light emitting diode OLED may be initialized.

During a fourth interval d of the frame, when a low-level $n^{th}$ emission-on voltage is applied to the $n^{th}$ emission control line ELn, the fifth and sixth transistors T5 and T6 may be turned on, and the remaining transistors T1, T2, T3, T4, and T7 may be turned off.

Accordingly, the first transistor T1 may be turned on by the voltage stored in the first capacitor CST and corresponding to the data voltage Vdata, and a driving current corresponding to the data voltage Vdata may flow through the organic light emitting diode OLED. As a result, the organic light emitting diode OLED may generate light having a gray scale corresponding to an image.

Figure 4A:
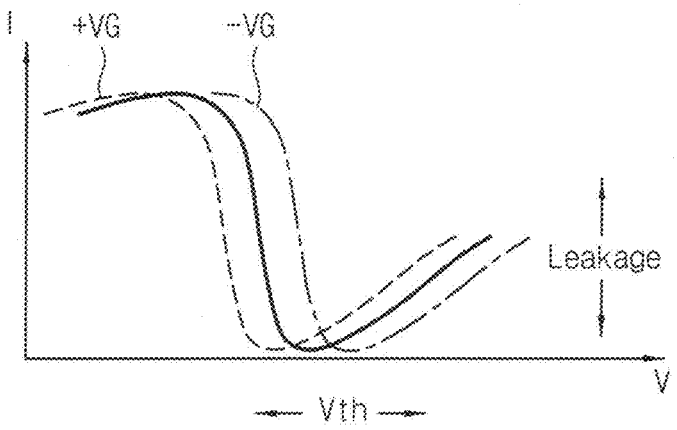
FIGS. 4A and 4B are I-V curves for a transistor having a double gate structure according to embodiments.
Figure 4B:
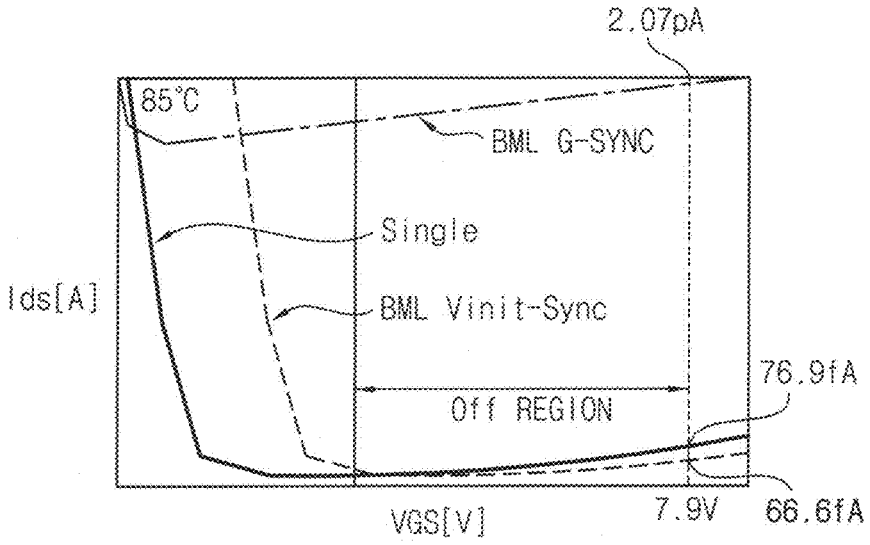

FIGS. 4A and 4B are I-V curves for a transistor having a double gate structure according to embodiments.

Referring to FIGS. 4A and 4B, curves show I-V characteristics of a transistor when the transistor is driven at a high temperature of 85 degrees Celsius (° C.).

Referring to FIG. 4A, upon the driving at high temperatures, when a positive bias voltage +VG is applied to a second gate electrode of a transistor having a double gate structure, the threshold voltage Vth may move to a negative side so that the leakage current may be increased. On the contrary, when a negative bias voltage −VG is applied to the second gate electrode of the transistor having the double gate structure, the threshold voltage Vth may move to a positive side so that the leakage current may be reduced.

Referring to FIG. 4B, in a transistor having a double gate structure according to Comparative Example 1 (BML G-Sync), a gate signal that is the same as a signal applied to a first gate electrode may be applied to a second gate electrode.

In a transistor having a single gate structure according to Comparative Example 2 (Single), a gate signal may be applied to only a first gate electrode.

In a transistor having a double gate structure according to an embodiment (BML Vinit-Sync), a negative (−) gate signal different from a gate signal applied to a first gate electrode may be applied to a second gate electrode.

As a result of measuring an off-leakage current at a gate/source voltage VGS (i.e., voltage between gate electrode and source electrode of a transistor) of about 7.9 voltages (V), the transistor having the double gate structure according to Comparative Example 1 (BML G-Sync) had a leakage current Ids of about 2.07 picoamperes (pA), the transistor having the single gate structure according to Comparative Example 2 (Single) had a leakage current Ids of about 76.9 femtoamperes (fA), and the transistor having the double gate structure according to the embodiment (BML Vinit-Sync) had a leakage current Ids of about 66.6 fA.

Accordingly, in the transistor having the double gate structure, when the negative (−) gate signal different from the signal applied to the first gate electrode is applied to the second gate electrode, it was found that the off-leakage current is reduced.

As described above, in the pixel circuit, the negative bias voltage may be applied to the second gate electrodes of the fourth transistor T4 configured to control the initialization of the previous data voltage charged in the capacitor CST and the third transistor T3 configured to control the charging of the capacitor CST with the data voltage thereof, so that the leakage currents may be reduced when the third and fourth transistors T3 and T4 are driven at high temperatures (e.g., 85° C.). Accordingly, deterioration of display quality due to the leakage current may be improved.

Figure 5A:
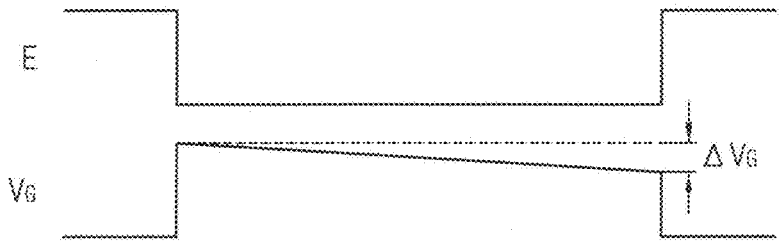
FIGS. 5A and 5B are conceptual diagrams for describing a leakage current of a transistor having a double gate structure according to embodiments.
Figure 5B:
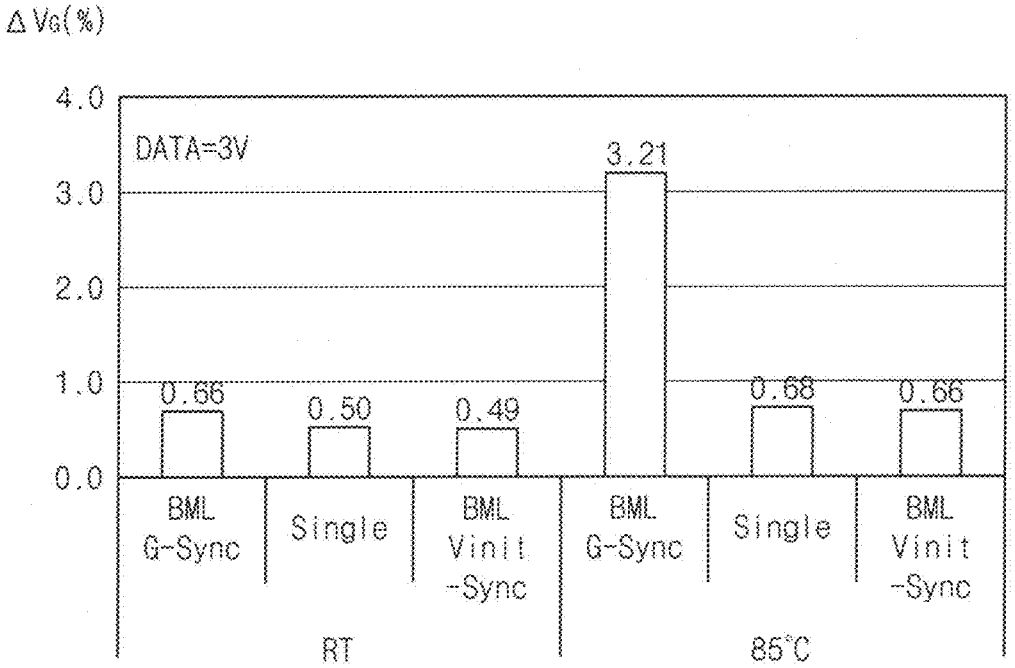

FIGS. 5A and 5B are conceptual diagrams for describing a leakage current of a transistor having a double gate structure according to embodiments.

Referring to FIGS. 2, 5A, and 5B, a deviation $\Delta V_G$ of a gate signal due to a leakage current of a transistor was measured in an emission-on interval in which the organic light emitting diode emits light.

In the transistor having the double gate structure according to Comparative Example 1 (BML G-Sync), a gate signal that is the same as a first gate signal applied to the first gate electrode may be applied to the second gate electrode BML.

In the transistor having the single gate structure according to Comparative Example 2 (Single), the gate signal may be applied to only the first gate electrode.

In the transistor having the double gate structure according to the embodiment (BML Vinit-Sync), a second gate signal, which is a negative bias signal different from a first gate signal applied to the first gate electrode, may be applied.

First, when an operating temperature is a room temperature RT, the transistor having the double gate structure according to Comparative Example 1 (BML G-Sync) had a deviation $\Delta V_G$ of the first gate signal that is about 0.66 percentages (%), the transistor having the single gate structure according to Comparative Example 2 (Single) had a deviation $\Delta V_G$ of a first gate signal that is about 0.50%, and the transistor having the double gate structure according to the embodiment (BML Vinit-Sync) had a deviation $\Delta V_G$ of the first gate signal that is about 0.49%.

It was found that the leakage current is the minimum in the embodiment (BML Vinit-Sync) in which a negative bias signal Vinit different from the signal applied to the first gate electrode is applied to the second gate electrode.

When the operating temperature is a high temperature (85 degrees Celsius), the transistor having the double gate structure according to Comparative Example 1 (BML G-Sync) had a deviation $\Delta V_G$ of the first gate signal that is about 3.21%, the transistor having the single gate structure according to Comparative Example 2 (Single) had a deviation $\Delta V_G$ of the first gate signal that is about 0.68%, and the transistor having the double gate structure according to the embodiment (BML Vinit-Sync) had a deviation $\Delta V_G$ of the first gate signal that is about 0.66%.

It was found that the leakage current is remarkably small in the embodiment (BML Vinit-Sync) in which the negative bias signal Vinit different from the first gate signal applied to the first gate electrode is applied to the second gate electrode.

Therefore, according to the present embodiment, when the negative bias signal different from the first gate signal applied to the first gate electrode is applied to the second gate electrode of the transistor having the double gate structure, the leakage current may be reduced at high temperatures.

As described above, in the pixel circuit, the negative bias voltage may be applied to the second gate electrodes of the fourth transistor T4 configured to control the initialization of the previous data voltage charged in the capacitor CST and the third transistor T3 configured to control the charging of the capacitor CST with the data voltage thereof, so that the leakage currents may be reduced when the third and fourth transistors T3 and T4 are driven at high temperatures (e.g., 85° C.). Accordingly, the deterioration of display quality due to the leakage current may be improved.

Figure 6:
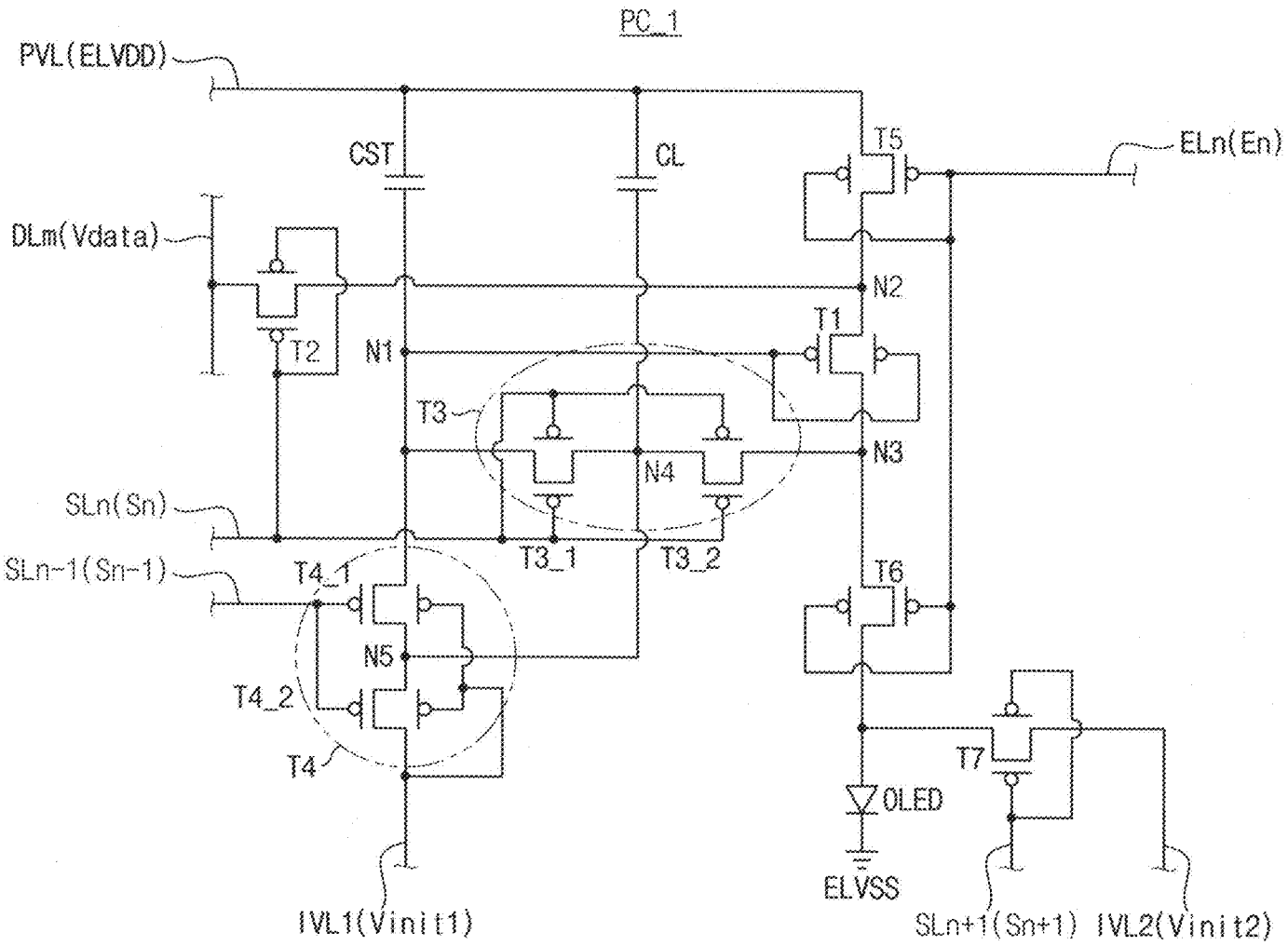
FIG. 6 is a circuit diagram illustrating a pixel circuit according to another embodiment.

FIG. 6 is a circuit diagram illustrating a pixel circuit according to another embodiment.

Referring to FIGS. 1 and 6, the pixel P may include a pixel circuit PC 1.

The pixel circuit PC 1 may further include a $m^{th}$ data line DLm, an $n^{th}$ scan line SLn, an $(n-1)^{th}$ scan line SLn−1, an $(n+1)^{th}$ scan line SLn+1, an $n^{th}$ emission control line ELn, a power supply voltage line PVL, a first initialization voltage line IVL1, and a second initialization voltage line IVL2.

According to an embodiment, a transistor may have a double gate structure having two gate electrodes. The transistor may be a P-type transistor, which may be turned on when a low-level voltage is applied to the gate electrode, and may be turned off when a high-level voltage is applied to the gate electrode. In another embodiment, transistors may be implemented as N-type transistors. In this case, a turn-on voltage may be the high-level voltage, and a turn-off voltage may be the low-level voltage.

According to an embodiment, a first transistor T1 may include a first gate electrode and a second gate electrode which are connected to a first node N1, a first electrode connected to a second node N2, and a second electrode connected to a third node N3.

A capacitor CST may include a first electrode connected to the power supply voltage line PVL and a second electrode connected to the first node N1. The power supply voltage line PVL may provide a high-power supply voltage ELVDD.

The second transistor T2 may include a first gate electrode and a second gate electrode configured to receive a first gate signal, a first electrode connected to the $m^{th}$ data line DLm, and a second electrode connected to the second node N2. The $m^{th}$ data line DLm may transmit a data voltage Vdata corresponding to the pixel P. The first gate signal may be an $n^{th}$ scan signal Sn provided from the scan driver 140, and may be transmitted through the $n^{th}$ scan line SLn.

The third transistor T3 may have a dual connection structure, and may include a third-first transistor T3-1 and a third-second transistor T3-2 connected to each other through a fourth node N4.

The third-first transistor T3-1 may include a first gate electrode and a second gate electrode which are configured to receive the first gate signal, a first electrode connected to the first node N1, and a second electrode connected to the fourth node N4.

The third-second transistor T3-2 may include a first gate electrode and a second gate electrode which are configured to receive the first gate signal (i.e., $n^{th}$ scan signal Sn), a first electrode connected to the fourth node N4, and a second electrode connected to the third node N3.

The first gate signal may be the $n^{th}$ scan signal Sn provided from the scan driver 140, and may be transmitted through the $n^{th}$ scan line SLn.

The fourth transistor T4 may have a dual connection structure, and may include a fourth-first transistor T4-1 and a fourth-second transistor T4-2 connected to each other through a fifth node N5.

The fourth-first transistor T4-1 may include a first gate electrode configured to receive a second gate signal, a first electrode connected to the first node N1, a second electrode connected to the fifth node N5, and a second gate electrode connected to the first initialization voltage line IVL1.

The fourth-second transistor T4-2 may include a first gate electrode configured to receive the second gate signal, a first electrode connected to the fifth node N5, and a second electrode and a second gate electrode connected to the first initialization voltage line IVL1.

The second gate signal GI may be an $(n-1)^{th}$ scan signal Sn−1 provided from the scan driver 140, and may be transmitted through the $(n-1)^{th}$ scan line SLn−1.

A second capacitor CL may include a first electrode and a second electrode. The first electrode connected to the power supply voltage line PVL. The second electrode may be connected to the third transistor T3 and the fourth transistor T4 through the fourth node N4 and the fifth node N5, respectively. The second capacitor CL may control leakage currents of the third transistor T3 and the fourth transistor T4.

The fifth transistor T5 may include a first gate electrode and a second gate electrode connected to the $n^{th}$ emission control line ELn, a first electrode connected to the power supply voltage line PVL, and a second electrode connected to the second node N2. The $n^{th}$ emission control line ELn may receive an $n^{th}$ emission control signal En provided from the emission driver 150.

The sixth transistor T6 may include a first gate electrode and a second gate electrode connected to the $n^{th}$ emission control line ELn, a first electrode connected to the third node N3, and a second electrode connected to an anode electrode of the organic light emitting diode OLED.

The seventh transistor T7 may include a first gate electrode and a second gate electrode configured to receive a third gate signal, a first electrode connected to the second initialization voltage line IVL2, and a second electrode connected to the anode electrode of the organic light emitting diode OLED. The second initialization voltage line IVL2 may transmit a second initialization voltage Vinit2 to the seventh transistor T7 for initializing the anode electrode.

The third gate signal may be an $(n+1)^{th}$ scan signal Sn+1 provided from the scan driver 140, and may be transmitted through the $(n+1)^{th}$ scan line SLn+1.

According to the present embodiment, a first initialization voltage Vinit1, which is a negative bias signal different from the second gate signal Sn−1 applied to the first gate electrode of the fourth transistor T4, may be applied to the second gate electrode of the fourth transistor T4 among the third transistor T3 and the fourth transistor T4.

Although not shown, in another embodiment, the first initialization voltage Vinit1, which is a negative bias signal different from the first gate signal Sn applied to the first gate electrode of the third transistor T3, may be applied to the second gate electrode of the third transistor T3 among the third transistor T3 and the fourth transistor T4.

As described above, in the pixel circuit, the negative bias voltage may be applied to at least one of the second gate electrodes of the fourth transistor T4 and the third transistor T3, so that the leakage currents may be reduced upon the driving at high temperatures. Here, the fourth transistor T4 is configured to control the initialization of the previous data voltage charged in the capacitor CST, and the third transistor T3 is configured to control the charging of the capacitor CST with the data voltage thereof. Accordingly, the deterioration of display quality due to the leakage current may be improved.

According to the above embodiments, transistors of a pixel circuit have a double gate structure including a first gate electrode and a second gate electrode, and a negative bias voltage is applied to a second gate electrode of at least one transistor configured to control the charging of a capacitor among the transistors, so that a leakage current can be reduced upon the driving at high temperatures. Accordingly, display quality can be prevented from deteriorating due to the leakage current.

ABILITY OF INDUSTRIAL UTILITY

The present invention may be applied to a display device and various devices and systems including the display device. For example, the present invention may be applied to a smart phone, a cellular phone, a personal digital assistant ('PDA"), a portable multimedia player ("PMP"), a digital camera, a camcorder, a personal computer ("PC"), a server computer, a workstation, a laptop, a digital TV, a set top box, a music player, a portable game console, a car navigation system, a smart card, a printer, and the like.

The foregoing is illustrative of embodiments and is not to be construed as limiting thereof. Although a few embodiments have been described, those skilled in the art will readily appreciate that many modifications are possible in the embodiments without materially departing from the novel teachings and advantages of the present inventive concept. Accordingly, all such modifications are intended to be included within the scope of the present inventive concept as defined in the claims. Therefore, it is to be understood that the foregoing is illustrative of various embodiments and is not to be construed as limited to the specific embodiments disclosed, and that modifications to the disclosed embodiments, as well as other embodiments, are intended to be included within the scope of the appended claims.

The invention claimed is:

1. A pixel circuit comprising:

an organic light emitting diode which generates light for displaying an image;

a first transistor including a first gate electrode connected to a first node, a first electrode connected to a second node, and a second electrode connected to a third node;

a first capacitor including a first electrode which receives a power supply voltage and a second electrode connected to the first node;

a second transistor including a first gate electrode which receives a first gate signal, a first electrode which receives a data voltage, and a second electrode connected to the second node;

a third transistor including a first gate electrode which receives the first gate signal, a first electrode connected to the first node, and a second electrode connected to the third node;

a fourth transistor including a first gate electrode which receives a second gate signal, a first electrode connected to the first node, a second electrode which receives a first initialization voltage, and a second gate electrode which receives the first initialization voltage; and a seventh transistor including a first gate electrode which receives a third gate signal, a first electrode which receives a second initialization voltage, and a second electrode connected to an anode electrode of the organic light emitting diode.

2. The pixel circuit of claim 1, wherein the third transistor further includes a second gate electrode which receives the first gate signal.

3. The pixel circuit of claim 1, wherein the second gate signal is a previous signal applied before the first gate signal, and the third gate signal is a next signal applied after the first gate signal.

4. The pixel circuit of claim 1, further comprising:

a fifth transistor including a first gate electrode which receives an emission control signal, a first electrode which receives the power supply voltage, and a second electrode connected to the second node; and a sixth transistor including a first gate electrode which receives the emission control signal, a first electrode connected to the third node, and a second electrode connected to the anode electrode of the organic light emitting diode.

5. The pixel circuit of claim 4, wherein each of the first, second, fifth, sixth, and seventh transistors further includes a second gate electrode overlapping the first gate electrode and which receives a same signal as a signal applied to the first gate electrode.

6. The pixel circuit of claim 1, wherein the first initialization voltage is set as a negative voltage with respect to a reference voltage, and is greater than the second initialization voltage.

7. The pixel circuit of claim 6, wherein the third transistor further includes a second gate electrode which receives the first initialization voltage.

8. The pixel circuit of claim 6, wherein the fourth transistor includes a fourth-first transistor and a fourth-second transistor and haves a dual connection structure in which the fourth-first transistor and the fourth-second transistor are connected to each other through a fifth node.

9. The pixel circuit of claim 8, wherein the third transistor includes a third-first transistor and a third-second transistor and haves dual connection structure in which the third-first transistor and the third-second transistor are connected to each other through a fourth node.

10. The pixel circuit of claim 9, further comprising:

a second capacitor including a first electrode which receives the power supply voltage and a second electrode connected to the fourth and fifth nodes.

11. A display device comprising:

a display panel including a pixel circuit that includes:

an organic light emitting diode which generates light for displaying an image, a first transistor including a first gate electrode connected to a first node, a first electrode connected to a second node, and a second electrode connected to a third node, a first capacitor including a first electrode which receives a power supply voltage and a second electrode connected to the first node, a second transistor including a first gate electrode which receives a first scan signal, a first electrode which receives a data voltage, and a second electrode connected to the second node, a third transistor including a first gate electrode which receives the first scan signal, a first electrode connected to the first node, and a second electrode connected to the third node, a fourth transistor including a first gate electrode which receives a second scan signal, a first electrode connected to the first node, a second electrode which receives a first initialization voltage, and a second gate electrode which receives the first initialization voltage, and a seventh transistor including a first gate electrode which receives a third scan signal, a first electrode which receives a second initialization voltage, and a second electrode connected to an anode electrode of the organic light emitting diode; and a scan driver which generates a plurality of scan signals to provide the scan signals to the display panel.

12. The display device of claim 11, wherein the third transistor further includes a second gate electrode which receives the first gate signal.

13. The display device of claim 11, wherein the first scan signal is an $n^{th}$ scan signal, the second scan signal is an $(n-1)^{th}$ scan signal, and the third scan signal is an $(n+1)^{th}$ scan signal, and n is a natural number more than 1.

14. The display device of claim 11, wherein the pixel circuit further includes:

a fifth transistor including a first gate electrode which receives an emission control signal, a first electrode which receives the power supply voltage, and a second electrode connected to the second node; and a sixth transistor including a first gate electrode which receives the emission control signal, a first electrode connected to the third node, and a second electrode connected to the anode electrode of the organic light emitting diode.

15. The display device of claim 14, wherein each of the first, second, fifth, sixth, and seventh transistors further includes a second gate electrode overlapping the first gate electrode and which receives a same signal as a signal applied to the first gate electrode.

16. The display device of claim 11, wherein the first initialization voltage is set as a negative voltage with respect to a reference voltage, and is greater than the second initialization voltage.

17. The display device of claim 16, wherein the third transistor further includes a second gate electrode which receives the first initialization voltage.

18. The display device of claim 16, wherein the fourth transistor includes a fourth-first transistor and a fourth-second transistor and has a dual connection structure in which the fourth-first transistor and the fourth-second transistor are connected to each other through a fifth node.

19. The display device of claim 18, wherein the third transistor includes a third-first transistor and a third-second transistor and has a dual connection structure in which the third-first transistor and the third-second transistor are connected to each other through a fourth node.

20. The display device of claim 19, wherein the pixel circuit further includes:

a second capacitor including a first electrode which receives the power supply voltage and a second electrode connected to the fourth and fifth nodes.

* * * * *